US006811152B2

(12) United States Patent
Delfosse et al.

(10) Patent No.: US 6,811,152 B2
(45) Date of Patent: Nov. 2, 2004

(54) METHOD AND DEVICE FOR CONTROLLING THE ORIENTATION AND ALIGNMENT OF INDIVIDUAL SHEETS OF PAPER PASSING ON A CONVEYOR

(75) Inventors: Christian Delfosse, St. Germain (BE); Philippe Dumont, Grivegnee (BE)

(73) Assignee: C. P. Bourg S.A., Ottignies (BE)

( * ) Notice: Subject to any disclaimer, the term of this patent is extended or adjusted under 35 U.S.C. 154(b) by 32 days.

(21) Appl. No.: 10/322,754

(22) Filed: Dec. 19, 2002

(65) Prior Publication Data

US 2003/0146568 A1 Aug. 7, 2003

(51) Int. Cl.[7] ..... B65H 5/00

(52) U.S. Cl. ..... 271/225; 271/228; 271/250; 271/184

(58) Field of Search ..... 271/225, 228, 271/250, 252, 184, 185

(56) References Cited

U.S. PATENT DOCUMENTS

| | | | | | |
|---|---|---|---|---|---|
| 4,165,870 | A | * | 8/1979 | Fallon et al. | 271/10.09 |
| 4,756,521 | A | * | 7/1988 | Martin | 271/225 |
| 4,927,132 | A | * | 5/1990 | Westover | 271/225 |
| 4,928,807 | A | * | 5/1990 | Auerbach | 198/379 |
| 5,915,689 | A | * | 6/1999 | Everdyke et al. | 271/236 |
| 6,343,686 | B1 | * | 2/2002 | Whiting et al. | 198/379 |
| 6,581,929 | B2 | * | 6/2003 | Hiramitsu | 271/228 |

* cited by examiner

*Primary Examiner*—David H. Bollinger
(74) *Attorney, Agent, or Firm*—Stuart J. Friedman

(57) ABSTRACT

A method of and a device for controlling the orientation and the alignment of individual sheets of paper travelling on a sheet conveyor are provided. Each sheet passes over a pair of closely spaced rotating disks inserted between upstream and downstream sheet conveyor sections. Each sheet is locally engaged with each disk in a limited contact area. The contact areas between the sheet and each disk are varied so as to achieve a target orientation or alignment of the sheet.

19 Claims, 10 Drawing Sheets

METHOD AND DEVICE FOR CONTROLLING THE ORIENTATION AND ALIGNMENT OF INDIVIDUAL SHEETS OF PAPER PASSING ON A CONVEYOR

FIELD OF THE INVENTION

The present invention generally relates to the art of paper handling and, in particular, to a method and a device for controlling the orientation and alignment of individual sheets of paper passing on a conveyor.

BACKGROUND OF THE INVENTION

Sheets of paper that travel individually along a conveyor are usually required to have a predetermined alignment and orientation. Conventionally, the conveyor has an alignment rail that extends parallel to the direction of sheet travel and the sheets are driven on the conveyor with a major component in the general travel direction and a small component towards the alignment rail, thereby forcing the sheets to move into abutment with the rail. An alignment rail may also correct potential orientation errors of the sheets by slightly rotating the sheets in the course of the alignment process. With increasing speeds of sheet travel and with relatively light paper, however, there is a risk that the sheets are damaged by being forced into abutment on the alignment rail. Also, such an alignment rail can only correct for relatively small errors of sheet alignment and orientation, and it can neither introduce a major offset of sheet travel with respect to an original sheet alignment, nor can it produce a 90° rotation of the sheets so as to change their orientation or direction of travel, in a wide range of paper weight and at high speeds of sheet travel.

SUMMARY OF THE INVENTION

The present invention provides a method and a device for controlling the orientation and alignment of individual sheets of paper passing on a conveyor, wherein even large errors of sheet alignment and sheet orientation can be corrected reliably and without the risk of sheet damage in a wide range of paper weight and at high continuous speeds of sheet travel, and wherein optionally an offset of sheet travel with respect to an original sheet alignment can be introduced, or a 90° rotation of the sheets can be produced so as to change the orientation or direction of travel of the sheets.

In accordance with the invention, a method of controlling at least one of the orientation and alignment of individual sheets of paper travelling on a conveyor is provided. Each sheet passes over a pair of closely spaced rotating disks and the sheet is locally engaged with each disk in a limited contact area, and the contact areas between the sheet and each disk are varied so as to achieve a target orientation or alignment of the sheet. When a sheet is first engaged by a rotating disk, the point of contact should be such that, at the point of contact, the tangential speed component of the disk is parallel to the sheet travel direction on the conveyor section upstream from the disks. Also, the tangential speed component should be of the same value as the upstream travelling speed of the sheet. As soon as the sheet is released from the upstream conveyor section, it is fully under control of the rotating disks, and the sheet travel direction can be acted on by changing the points of engagement between the sheet and the disks to shift the sheet laterally, or the disks are driven at different speeds as a sheet passes to rotate the sheet. Both actions can be combined to change the travel direction and simultaneously to rotate the sheet, whereby both of the alignment and the orientation of the sheet are controlled. As soon as the sheet is engaged by the downstream conveyor section, it should be released from the rotating disks. Just prior to this moment of sheet transfer from the pair of rotating disks to the downstream conveyor section, the sheet should be engaged by the disks at locations where the tangential speed component has the same direction as the travel direction of the downstream conveyor section. The travel directions of the upstream and downstream conveyor sections can be the same or different from each other and even be perpendicular to each other, the proposed method being capable of producing a full 90° rotation of a sheet without having to slow-down the sheet travel speed upon passing over the rotating disks.

The present invention also provides a device for controlling at least one of the orientation and alignment of individual sheets of paper travelling on a conveyor, which is particularly designed to perform the inventive method. The device comprises a pair of closely spaced rotating disks arranged on a sheet travel path between upstream and downstream sections of the conveyor. The device also comprises a pair of engagement members each associated with one of the disks to define a sheet passage gap where the sheet is locally clamped. The engagement members are each movable opposite a respective disk within a 90° sector of the disk defined between a radius parallel to and a radius perpendicular to the sheet travel direction. The engagement members are positioned in synchronism so that the sheet passing over the continuously rotating disks is driven by each sheet in the same direction, but the speed of rotation of the disks may be varied between the disks as the sheet passes so as to produce a rotation of the sheet.

To reduce the time necessary for movement of the engagement members, a plurality of selectively activatable engagement members can be arranged at regular intervals about the periphery of each disk, and only one of these engagement members will be active at a given time.

An engagement member can be an idle roller mounted on a first end of a pivotal carrier arm the pivot axis of which is co-axial with the axis of rotation of the associated disk. If a plurality of idle rollers are provided for each rotating disk, they are mounted on a carrier disk arranged opposite a respective rotating disk, the carrier disk being co-axial with the rotating disk and the idle rollers being retractable.

In an alternative embodiment, the engagement members are materialized by pneumatic means. Specifically, each rotating disk has a plurality of perforations distributed over its periphery, and a suction member is arranged on a side of the disk opposite a sheet facing side of the disk, the suction member being aligned with the perforations and movable about the axis of rotation of the disk within a 90° sector of the disk.

SHORT DESCRIPTION OF DRAWINGS

Further advantages and features of the invention will become apparent from the following description and from the appending drawings. In the drawings.

Figure 9B:
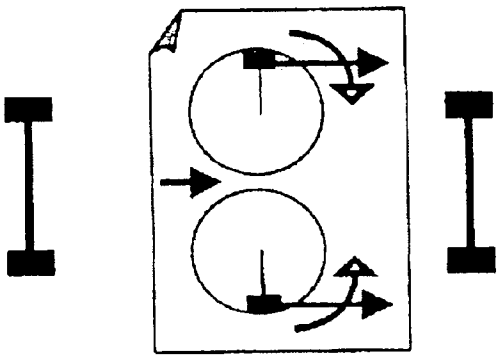
Figure 9A:
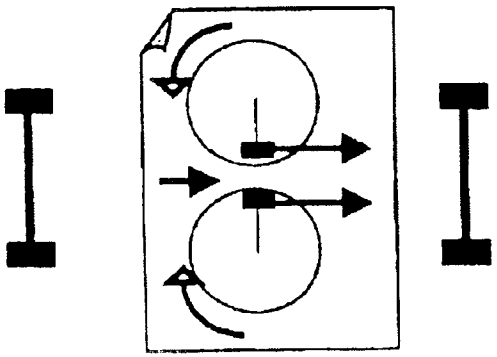
Figure 10:
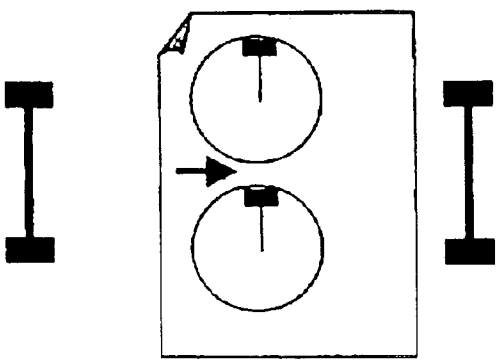
Figure 10:
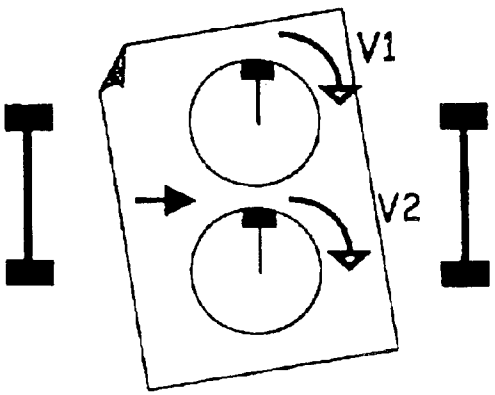
Figure 11:
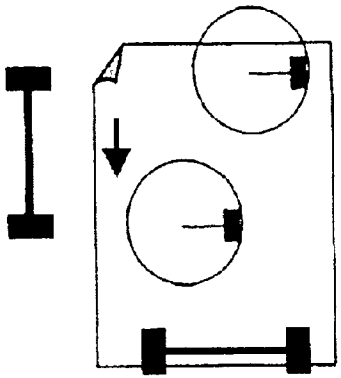
Figure 13:
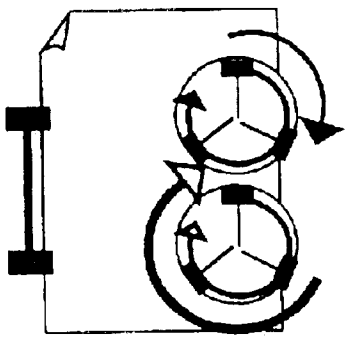
Figure 12:
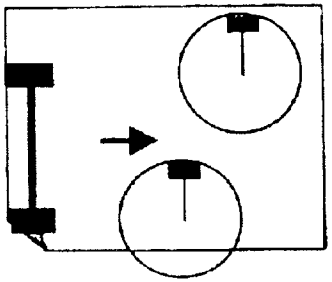
Figure 12:
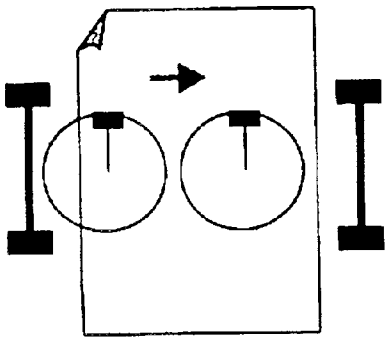
Figure 14:
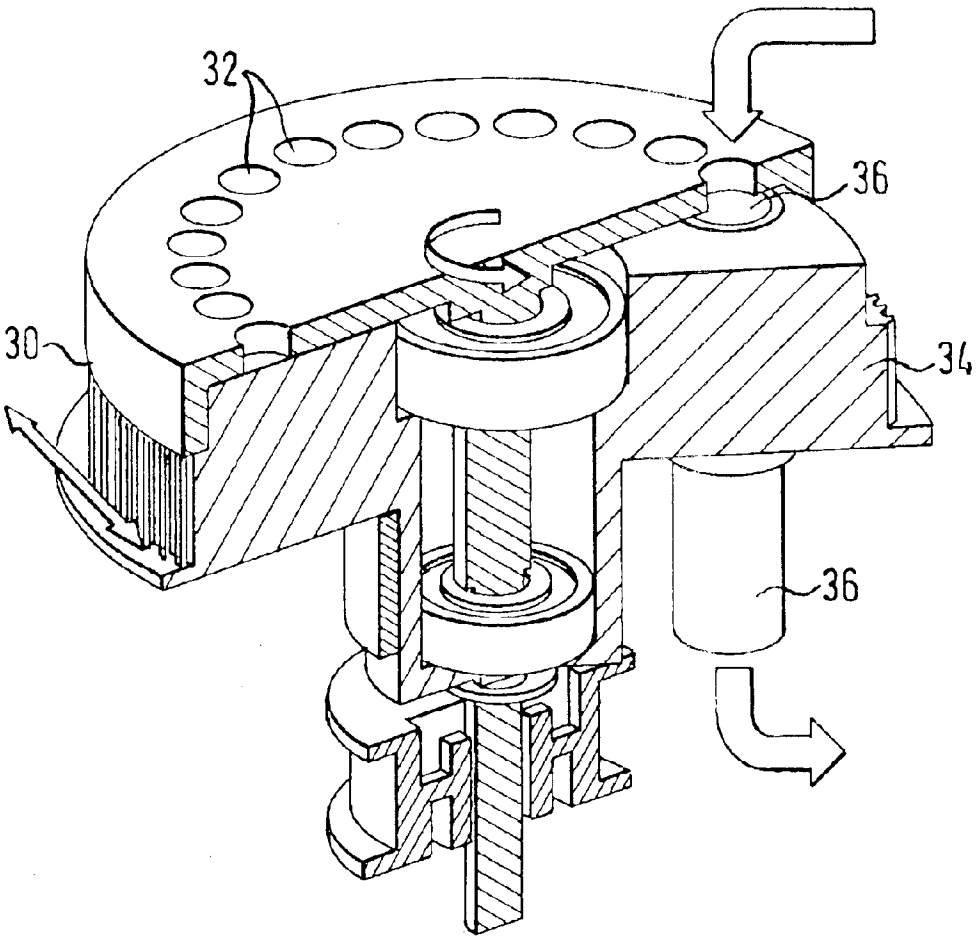
Figure 15:
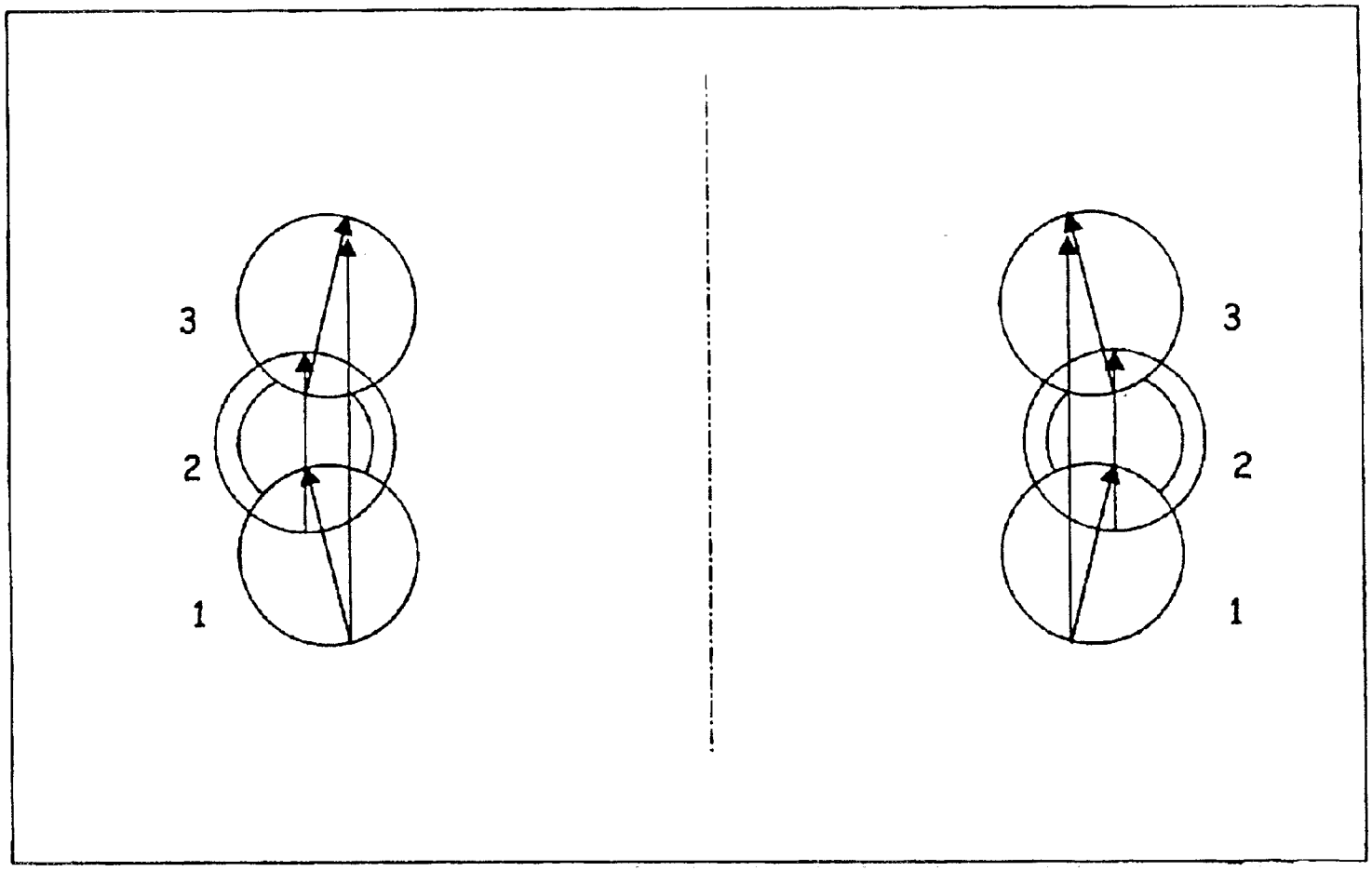
Figure 16:
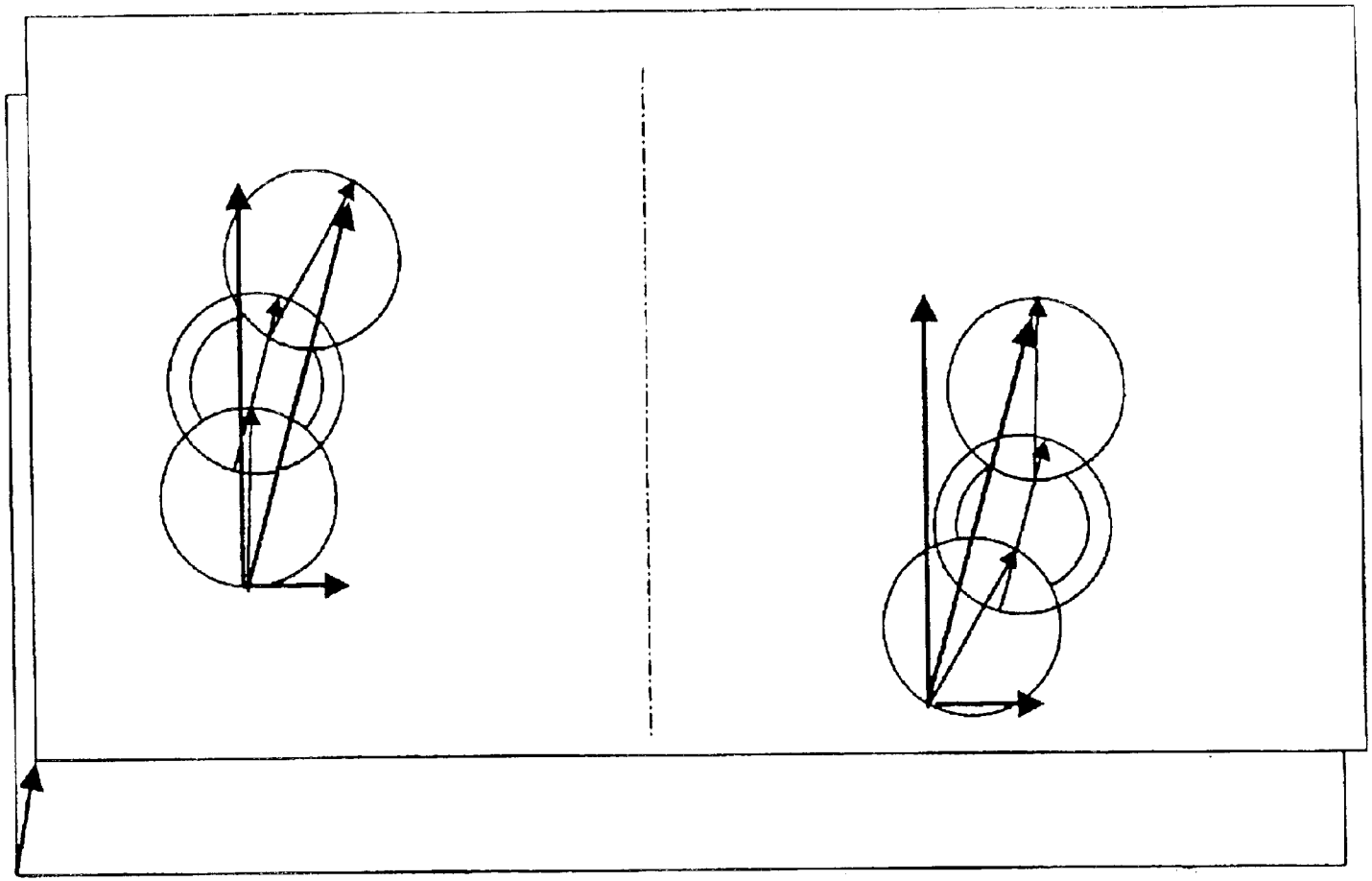

FIGS. 9*a* and 9*b* embodiments of a sheet travel control device with two disks rotating in opposite directions;

FIG. 10 illustrates a sheet passage process with a sheet rotation due to differential velocities of rotating disks in a sheet travel control device;

FIG. 11 shows an embodiment of a sheet travel control device with a pair of rotating disks shifted from each other in the sheet travel direction;

FIG. 12 shows an embodiment of a sheet travel control device with a pair of rotating disks each associated with a plurality of clamping rollers;

FIG. 13 shows an embodiment of a sheet travel control device with a pair of rotating disks aligned in the sheet travel direction;

FIG. 14 is a sectioned perspective view of a pneumatic embodiment of a sheet travel control device;

FIG. 15 illustrates the operation of a pneumatic sheet travel control device in a scenario without change of sheet travel direction; and FIG. 16 illustrates the operation of the pneumatic sheet travel control device in a scenario with a change of sheet travel direction.

DETAILED DESCRIPTION OF PREFERRED EMBODIMENTS

Figure 2:
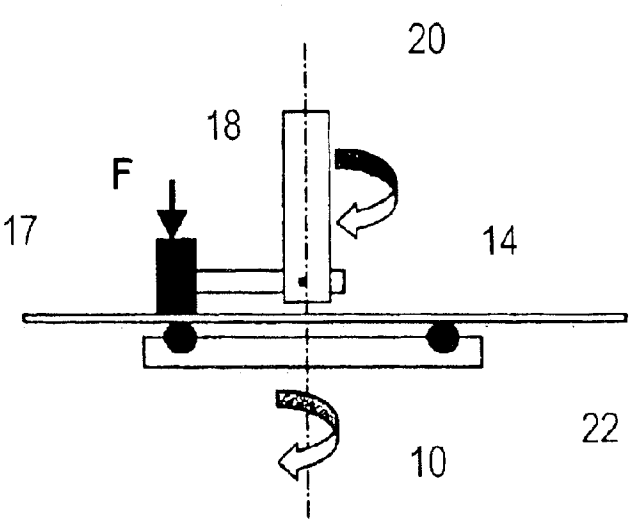
FIG. 2 is a schematic side view of the disk and clamping roller in FIG. 1.
Figure 1:
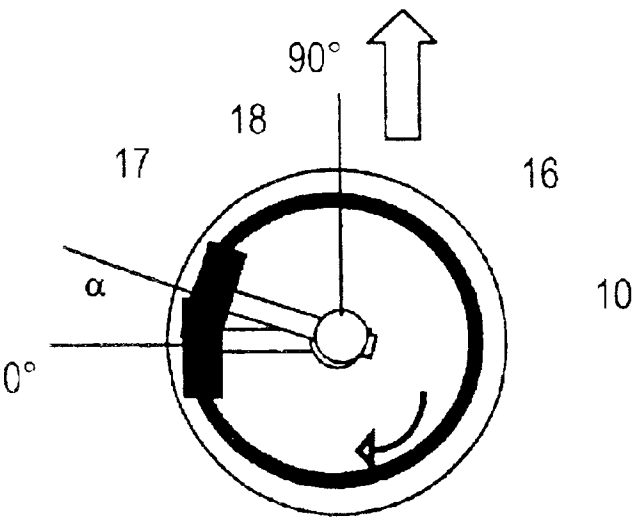
FIG. 1 is a schematic plan view of rotating disk and a co-operating clamping roller in two different engagement positions along the periphery of the disk.

With reference to FIGS. 1 and 2, a sheet handling unit includes a disk 10 that continuously rotates about an axis 12, although not necessarily at a constant speed of rotation. Disk 10 has an upper horizontal face that carries a plurality of closely spaced idle balls 14 aligned along the periphery of disk 10 to define a circular engagement track 16. Opposite engagement track 16 is an idle clamping roller 17 mounted on a free end of a horizontal carrier arm 18 the opposed end of which is attached to a shaft 20 that is co-axial with axis 12 of disk 10. Shaft 20 is connected to a rotary drive that can be controlled to pivot carrier arm 18 within a 90° sector so that it can assume any position within this sector. FIG. 1 illustrates a 90° position and an angle $\alpha$ position of carrier arm 18. The clamping roller 17 and the idle balls 14 define a gap where a sheet of paper 22 is locally clamped. In FIG. 1, a hollow arrow indicates the direction of sheet travel on a conveyor, and a solid arrow indicates the direction of rotation of disk 10. The 90° sector of sheet engagement is defined between axis 12, the direction of sheet travel and a line perpendicular to that direction.

Figure 3:
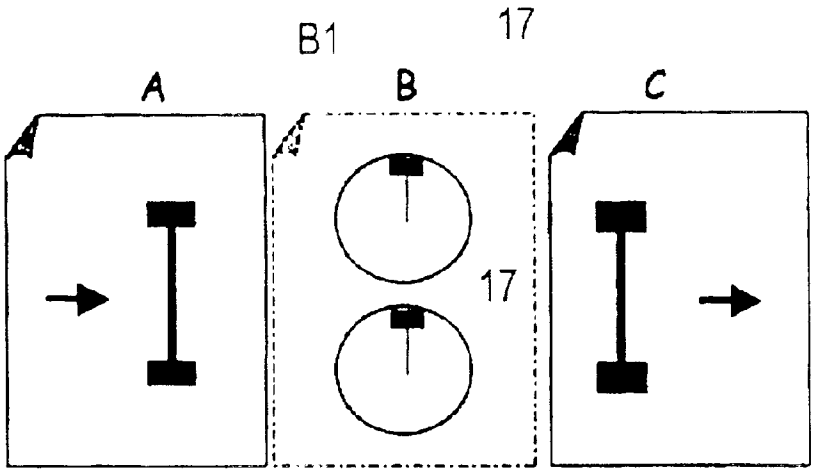
FIG. 3 is a schematic plan view of a sheet conveyor with an intermediate sheet travel control device in a condition of sheet take-over.

With reference to FIG. 3, an upstream sheet conveyor section A, an intermediate sheet travel control device B and a downstream sheet conveyor section C are shown. Sheet travel control device B includes a pair of sheet handling units B1 and B2 each of the kind shown in FIGS. 1 and 2, although other embodiments could be envisioned. Units B1 and B2 are closely spaced from each other and aligned in a direction perpendicular to the general direction of sheet travel indicated by solid arrows in FIG. 3. Referring to FIG. 1, rollers 17 of both units B1 and B2 are shown in a 0° position. In this position, a sheet 22B engaged between the disk and roller of each unit B1, B2 experiences a drive in a direction parallel to the sheet travel direction, as determined by the tangential velocity at the peripheral point of contact between the disk, the sheet and the idle roller. Thus, the sheet passes without a change of orientation and alignment.

Figure 4:
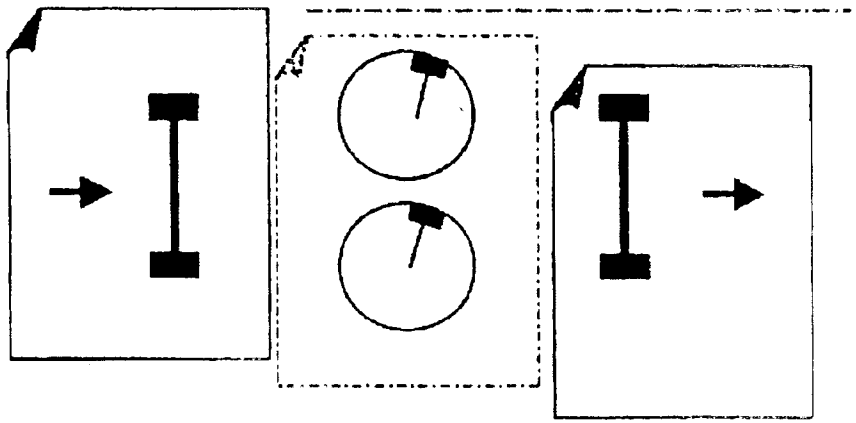
FIG. 4 is a similar view but showing the device in a condition of sheet deflection.

With reference now to FIG. 4, the positions of the idle rollers have been changed in synchronism by pivoting the respective carrier arms so that the tangential velocity at the points of contact with respect to the periphery of each disk is inclined to the general direction of sheet travel. Therefore, the sheet is advanced with a transverse component of movement and an offset with respect to the original alignment of the sheet is generated. It is to be noted here that the original orientation of the sheet is unchanged.

Figure 5:
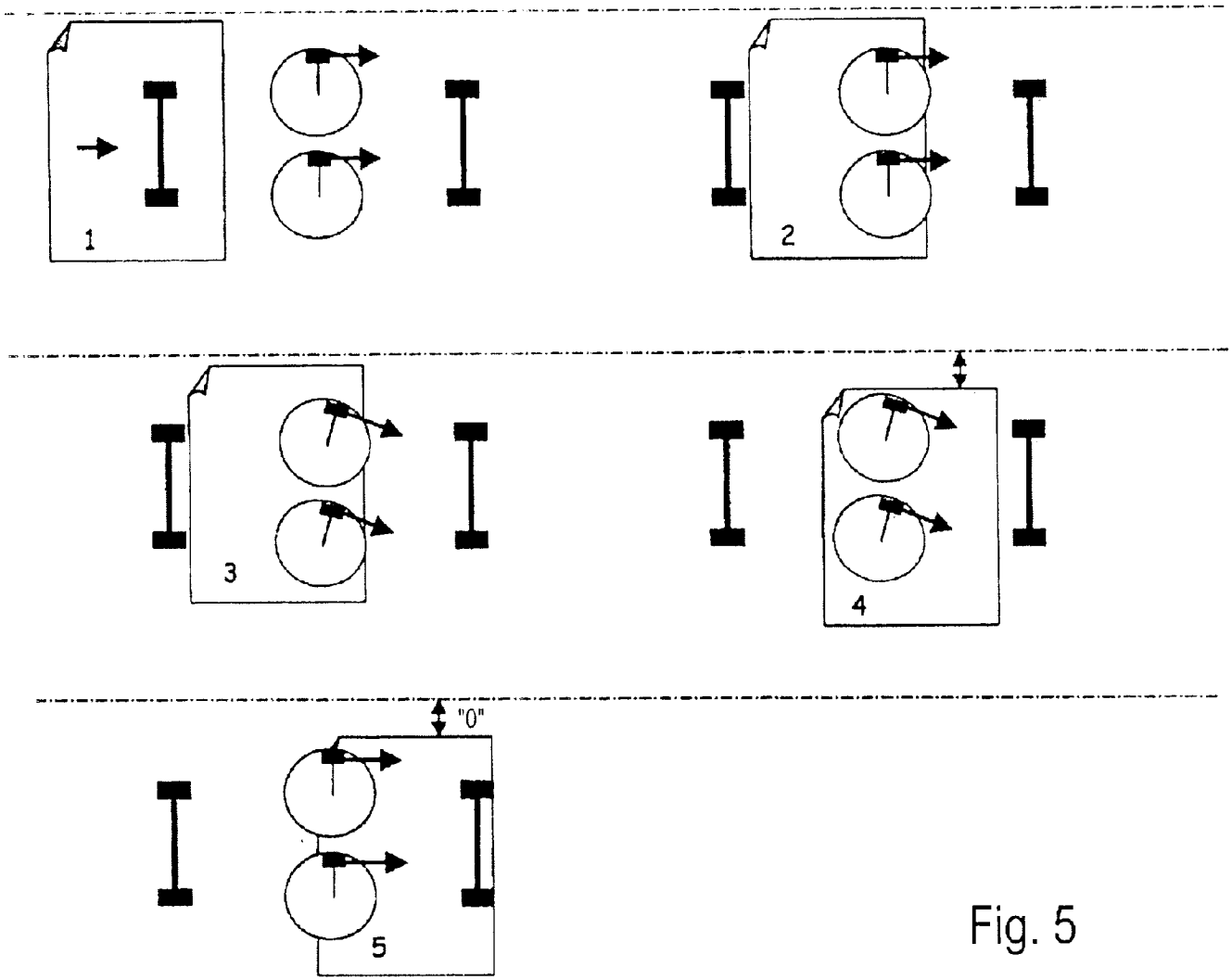
FIG. 5 illustrates a sheet passage process with generation of a lateral offset.
Figure 6:
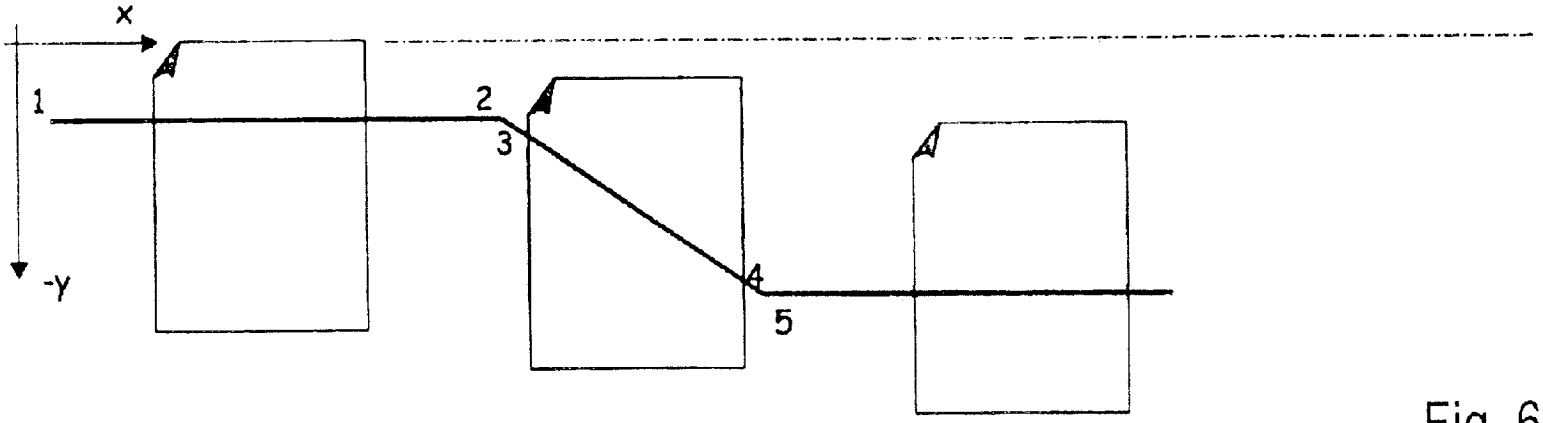
FIG. 6 illustrates the resulting sheet trajectory in the process shown in FIG. 5.

FIGS. 5 and 6 illustrate the typical successive steps of a complete offset generating procedure. At step 1, the sheet is fully under control of the upstream conveyor section. At step 2, the sheet is released from the upstream conveyor section and engaged by the sheet travel control device, which initially advances the sheet in the original travel direction. In steps 3 and 4, the sheet is moved in a direction inclined to the original travel direction. In step 5, the idle rollers have been restored to the original 0° position, and the sheet is advanced to the downstream conveyor section, but with an offset "O" with respect to the original sheet alignment. To avoid any risk of antagonism that would be detrimental to a rapid continuous flow of successive sheets through the sheet travel control device, each sheet is released from engagement with the device at the moment the sheet is engaged by the downstream conveyor section.

Figure 7:
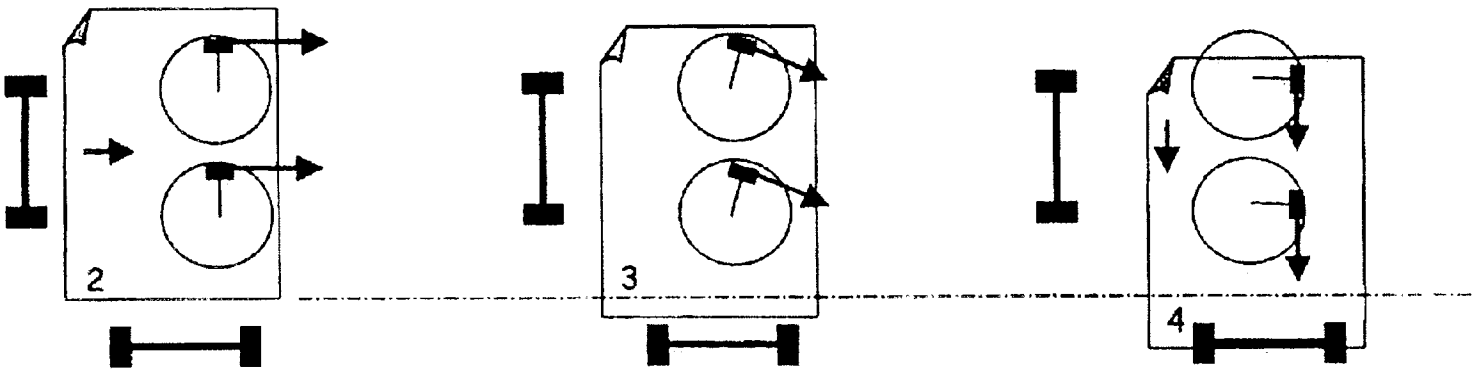
FIG. 7 illustrates a process of sheet passage with a 90° change of travel direction.
Figure 8:
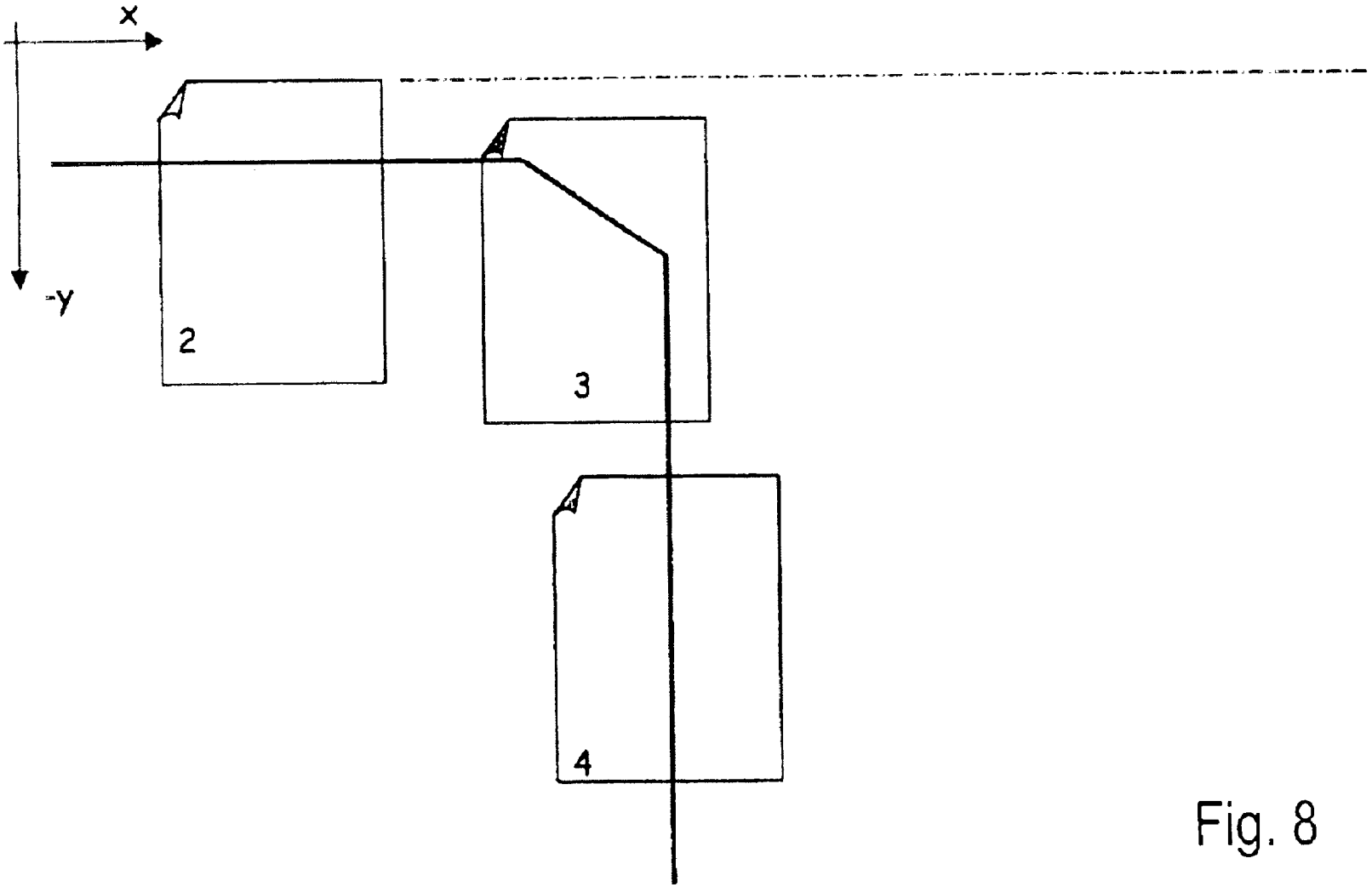
FIG. 8 illustrates the resulting sheet trajectory in the process shown in FIG. 7.

FIGS. 7 and 8 illustrate a scenario where the upstream and downstream conveyor sections are mutually perpendicular and the orientation of the sheet with respect to its travelling direction is changed by 90°. Steps 1, 2 and 3 are identical with those in FIGS. 5 and 6. In step 4, the idle rollers are pivoted to a full 90° position so that the sheet is advanced in a direction perpendicular to the original travel direction and identical with the travel direction on the downstream conveyor section, without having been rotated.

In the above embodiments, both disks of the sheet travel control device are driven in the same direction of rotation, and the idle rollers assume identical angular positions.

FIGS. 9*a* and 9*b* show embodiments where the two discs are driven in opposite directions. In this case, the idle rollers must assume angular positions mutually shifted by 180°.

In the above embodiments it is assumed that both disks of the sheet travel control device are driven at identical speeds so that the orientation of the sheet remains unchanged.

In the embodiment of FIG. 10, both disks are driven at different velocities, which can be varied as a sheet passes over the disks. A typical controller to effect this would include a microprocessor. In the scenario depicted in FIG. 10, one disk is driven at velocity V1 and the other at velocity V2, with V1>V2, thereby producing a counter-clock rotation of the sheet. The positions of the idle rollers remain unchanged, unless an offset is to be generated in addition to a sheet rotation.

In the above embodiments, both disks in the sheet travel control device are aligned perpendicular to the original direction of sheet travel.

In the embodiment of FIG. 11, the disks are shifted with respect to each other in the direction of sheet travel. This is the preferred embodiment when a sheet rotation is to be combined with a change of sheet travel direction.

A further embodiment depicted in FIG. 12 has both disks aligned in the direction of sheet ravel.

With reference to FIG. 13, an embodiment is shown where three idle rollers are associated with each rotating disk. Each set of rollers is carried by a carrier in the shape of a carrier disk or a star and rotatable within a sector of 90° with respect to the associated rotating disk. The idle rollers are selectively retractable, and only one of them is advanced at a time to engage a passing sheet of paper. By providing multiple rollers for each rotating disk, angular movements of the rollers can be reduced, thereby allowing higher process speeds.

In the above embodiment, a sheet is locally engaged by a rotating disk in that it is mechanically clamped between the disk and a clamping roller.

In the FIG. 14 embodiment, a sheet is pneumatically engaged by a rotating disk. Specifically, a rotating disk 30 has multiple closely spaced perforations 32 along its periphery. The upper face of disk 30 is exposed to a sheet passing thereover. A suction register 34 presents an opening 4 of a suction channel 36 to the opposite face of disk 30 in alignment with the perforations 32. Suction register 34 is rotated within a sector of 90° with respect to disk 30, in a manner analogous to the clamping rollers in the above embodiments. In this embodiment, a sheet is locally engaged with the upper face of disk 30 by pneumatic action, and the position of local engagement is controlled by virtue of controlling the angular position of suction register 34.

Although the pneumatic embodiment can be configured to operate in a manner analogous to the mechanical embodiments disclosed above, an even higher degree of flexibility and process control is achieved. This is illustrated by FIGS. 15 and 16.

In FIG. 15, a left-hand disk unit tends to deflect a passing sheet towards the left in a first step while a right-hand disk unit tends to deflect the sheet to the right by a like amount in the same step. Since both actions are opposed and of like magnitude, they cancel each other, but the sheet is under a strong constraint to advance in the original travel direction.

In FIG. 16, the left-hand disk unit tends to deflect a passing sheet towards the right while a right-hand disk unit tends to deflect the sheet also to the right, but by a larger amount. Due to the differing amounts of deflection that both disks attempt to impose upon the sheet, a lateral offset with respect to the original sheet alignment is generated under a strong constraint, thereby combining a high alignment accuracy with a high process speed.

What is claimed is:

1. A method of controlling at least one of the orientation and alignment of individual sheets of paper travelling on a conveyor, said method comprising the steps of:

passing each sheet over a pair of closely spaced rotating disks such that each sheet is locally engaged with each disk in a limited contact area; and varying the contact areas between the sheet and each disk so as to achieve a target orientation or alignment of the sheet.

2. The method of claim 1, including the step of arranging said disks in a sheet travel path defined by the conveyor so that a straight line extending between the axes of rotation of the disks is transverse to the sheet travel path.

3. The method of claim 1, wherein the contact areas between the disks and the sheet are varied in synchronism.

4. The method of claim 3, wherein the contact areas between the disks and the sheet are varied within a sector of substantially 90° defined on each disk between a line parallel to the sheet travel path and a line perpendicular to the sheet travel path.

5. The method of claim 4, including positively advancing the sheet by the conveyor along the sheet travel path upstream from the disks and by the conveyor downstream from the disks in either of a direction parallel to and a direction perpendicular to the sheet travel path.

6. The method of claim 4, wherein the sheet is advanced downstream from the disks with an offset with respect to a sheet alignment upstream from the disks.

7. The method of claim 1, comprising the step of controlling individually the speed of rotation for each of said disks.

8. The method of claim 7, wherein the disks are rotated in the same direction and the engagement areas between the sheet and the disks are located in the same sector of each disk with respect to the direction of sheet travel.

9. The method of claim 7, wherein the disks are rotated in opposite directions and the engagement areas between the sheet and the disks are located in opposite sectors of the disks with respect to the direction of sheet travel.

10. The method of claim 1, wherein the disks are rotated at varying speeds during the passage of a sheet over the disks.

11. The method of claim 1, wherein the engagement area between the sheet and each disk is defined by an idle roller opposite each disk and defining a sheet passage gap with a respective disk.

12. A device for controlling at least one of the orientation and alignment of individual sheets of paper travelling on a conveyor, comprising a pair of closely spaced rotating disks arranged on a sheet travel path between upstream and downstream sections of the conveyor, an a pair of engagement members each associated with one of said disks to define a sheet passage gap, and each of said engagement members being movable opposite a respective disk within a 90° sector of the disk defined between a radius parallel to and a radius perpendicular to the sheet travel direction.

13. The device of claim 12, wherein each engagement member comprises an idle roller mounted on a carrier arm that is pivotal about an axis coincident with an axis of rotation of a respective one of said disks.

14. The device of claim 12, wherein each engagement member comprises a plurality of idle rollers which are mounted on and distributed over the periphery of a rotatable carrier disk, each of said idle rollers being selectively advanced towards or retracted from a respective one of said disks and only one of said rollers contacting a sheet passing on the disk.

15. The device of claim 12, wherein at least one of said disks has a plurality of perforations distributed over its periphery, and a suction member is arranged on a side of the disk opposite a sheet facing side of the disk, the suction member being aligned with said perforations and movable about the axis of rotation of the disk within a 90° sector of the disk.

16. The device of claim 12, wherein the rotating disks have their axes of rotation aligned on a straight line perpendicular to the sheet travel direction.

17. The device of claim 12, wherein the rotating disks have their axes of rotation shifted with respect to each other in the sheet travel direction.

18. The device of claim 12, wherein the rotating disks are provided with a plurality of idle balls closely spaced along the periphery of a respective disk and on the surface of the disk facing a passing sheet.

19. The device of claim 12 and comprising a controller for individually and variably controlling the speed of rotation of each disk as a sheet passes over each disk.

* * * * *

UNITED STATES PATENT AND TRADEMARK OFFICE

CERTIFICATE OF CORRECTION

PATENT NO. : 6,811,152 B2
DATED : November 2, 2004
INVENTOR(S) : Christian Delfosse et al.

It is certified that error appears in the above-identified patent and that said Letters Patent is hereby corrected as shown below:

Title page,
Insert the following:
-- [30] Foreign Application Priority Data
Dec. 21, 2001 (DE) ……. 101 63 304.1 --

Signed and Sealed this

Seventeenth Day of May, 2005

JON W. DUDAS
*Director of the United States Patent and Trademark Office*